US005203885A

United States Patent [19]

Pastre et al.

[11] Patent Number: 5,203,885

[45] Date of Patent: Apr. 20, 1993

[54] MOLDING FINISHING TOOL AND METHOD OF MAKING

[76] Inventors: Scott J. Pastre; Michele L. Pastre, both of Surdan Mt. Rd., Sharon, Conn. 06069

[21] Appl. No.: 818,250

[22] Filed: Jan. 8, 1992

[51] Int. Cl.[5] ..... B24D 18/00

[52] U.S. Cl. ..... 51/298; 51/205 R; 51/295; 264/267

[58] Field of Search ..... 264/162, 131, 267; 51/293, 204, 205 R, 281 R, 287, 325, 298, 295

[56] References Cited

U.S. PATENT DOCUMENTS 151,847 6/1874 Cochran ..... 51/205 R
3,043,066 7/1962 Zrodowski ..... 511/298
3,813,830 6/1974 Hodge ..... 51/392

*Primary Examiner*—Bruce M. Kisliuk
*Assistant Examiner*—Jack Lavinder
*Attorney, Agent, or Firm*—Leon Gilden

[57] ABSTRACT

A "U" shaped support mounting a handle to a top surface thereof is positioned over a molding portion, wherein the support includes an opening through the top wall to receive a hardening compound, such as an epoxy resin, to fill a confronting cavity between the top wall and the mold member. The mold member is initially coated with a non-adhering coating such as a lubricant to permit ease of removal of the support subsequent to use, with the mold upon hardening coated with an adhesive and abrasive material for use as a sanding tool.

4 Claims, 4 Drawing Sheets

MOLDING FINISHING TOOL AND METHOD OF MAKING

BACKGROUND OF THE INVENTION

1. Field of the Invention

The field of invention relates to finishing tool structure, and more particularly pertains to a new and improved molding finishing tool and method of making for the formation of a tool to effect finish surfacing of various uniquely configured mold members.

2. Description of the Prior Art

In the finishing of wall molding such as found in homes of advanced age, such mold members are not to be replicated in the commercial market. Accordingly, such mold members must be carefully and painstakingly refinished to include the use of filling compounds and the subsequent sanding of such mold members. To minimize a costly and time consuming procedure of such finishing work, the instant invention sets forth an organization to create a finish sanding tool to effect a mirror image of a mold member to be finished. While the use of molds of various configurations are available in the prior art, prior art has not heretofore set forth an organization to effect the replication of mold members for a sanding block structure. The formation of mold members and the like and the use of molding type compounds are set forth in U.S. Pat. Nos. 4,762,562 to Suzuki setting forth a method of Preparing a molding mortar; 4,921,417 to Sato setting forth a unique manner of molding a configuration such as a clay Pigeon; and U.S. Pat. No. 4,767,801 to Suzuki, et al. setting forth a further example of molding material and a mold structure therefore.

As such, it may be appreciated that there continues to be a need for a new and improved molding finishing tool and method of making as set forth by the instant by the instant invention wherein the same is directed to ease of use as well as effectiveness in construction and in this respect, the Present invention substantially fulfills this need.

SUMMARY OF THE INVENTION

In view of the foregoing disadvantages inherent in the known types of sanding block apparatus now present in the prior art, the present invention provides a molding finishing tool and method of making wherein the same is arranged to provide a mirror image sanding block for the use in finishing uniquely configured molding pieces. As such, the general purpose of the present invention, which will be described subsequently in greater detail, is to provide a new and improved molding finishing tool and method of making which has all the advantages of the prior art molding finishing tools and none of the disadvantages.

To attain this, the present invention provides a "U" shaped support mounting a handle to a top surface thereof positioned over a molding portion, wherein the support includes an opening through the top wall to receive a hardening compound, such as an epoxy resin, to fill a confronting cavity between the top wall and the mold member. The mold member is initially coated with a non-adhering coating such as a lubricant to permit ease of removal of the support subsequent to use, with the mold upon hardening coated with an adhesive and abrasive material for use as a sanding tool.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and Practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved molding finishing tool and method of making which has all the advantages of the prior art molding finishing tools and none of the disadvantages.

It is another object of the present invention to provide a new and improved molding finishing tool and method of making which may be easily and efficiently manufactured and marketed.

It is a further object of the present invention to provide a new and improved molding finishing tool and method of making which is of a durable and reliable construction.

An even further object of the present invention is to Provide a new and improved molding finishing tool and method of making which is susceptible of a low cost of manufacture with regard to both materials and labor, and which accordingly is then susceptible of low prices of sale to the consuming public, thereby making such molding finishing tools economically available to the buying public.

Still yet another object of the present invention is to Provide a new and improved molding finishing tool and method of making which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
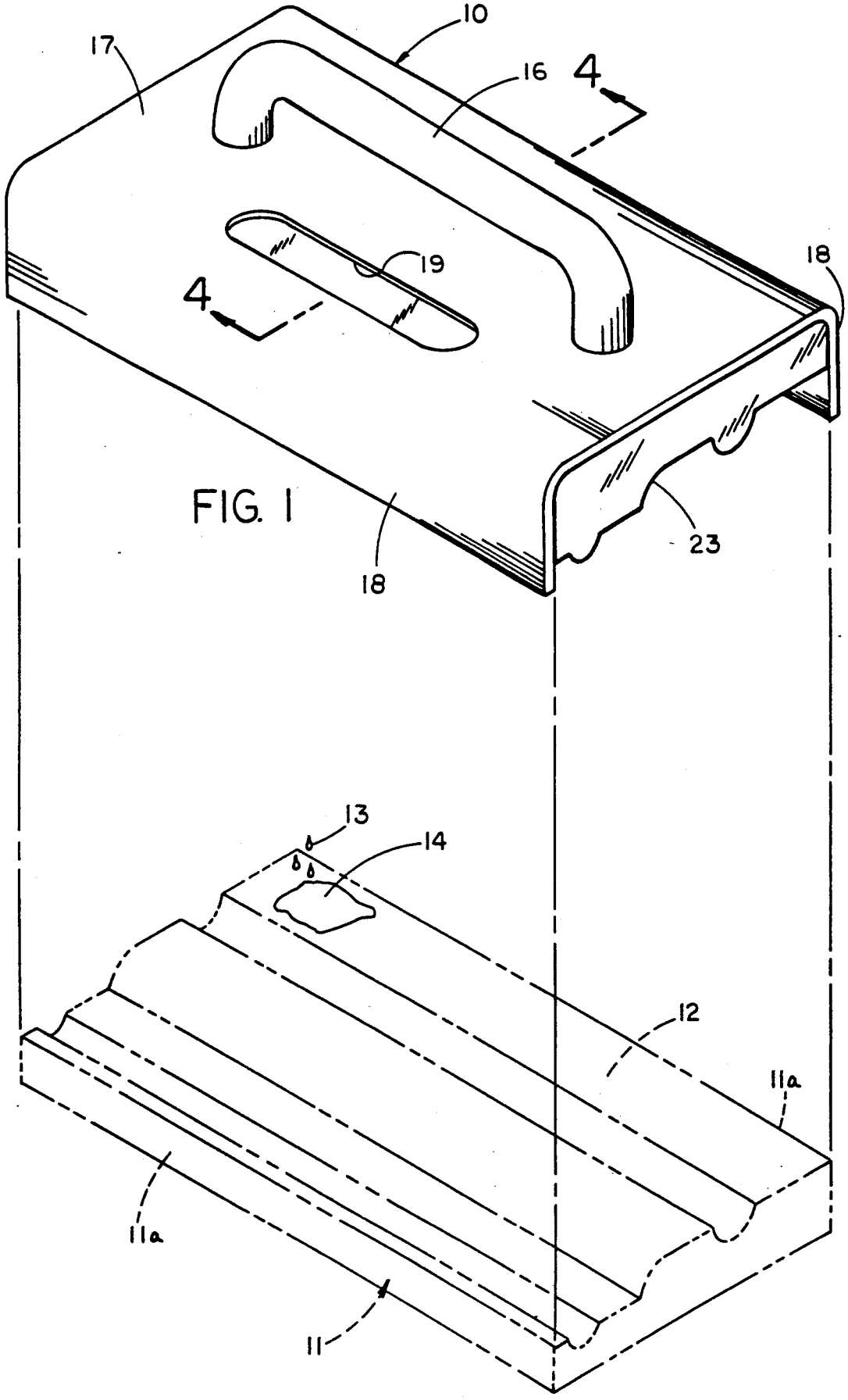
FIG. 1 is an isometric illustration of the molding finishing tool relative to a mold member to be replicated relative to a sanding block structure.
Figure 2:
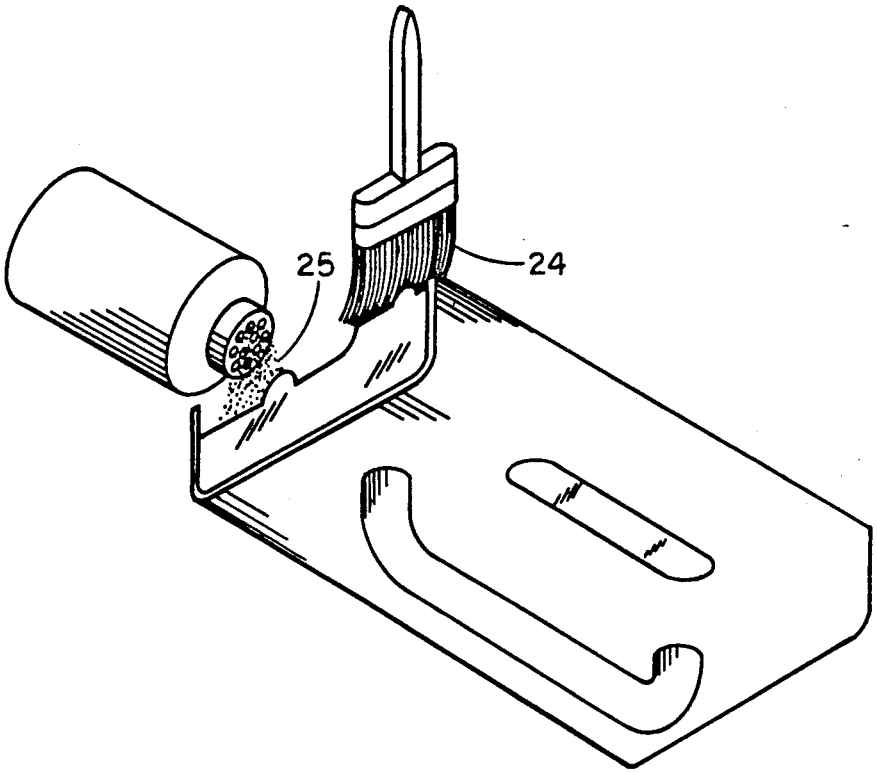
FIG. 2 is an isometric illustration of the invention receiving an adhesive and a subsequent layer of abrasive particles directed onto the adhesive.

With reference now to the drawings, and in particular to FIGS. 1 to 8 thereof, a new and improved molding finishing tool and method of making embodying the principles and concepts of the present invention and generally designated by the reference numeral 10 will be described.

More specifically, the invention as set forth by the foregoing specification includes a tool structure 10, as indicated in FIG. 1, that is formed for a molding member 11 to be finished. The molding member 11 includes molding member side walls 11*a* and a molding member undulating top surface 12. Oil 13 is directed onto the top surface 12 to form an oil layer 14, wherein subsequently, a "U" shaped support 15 is provided to include a support top wall 17 formed with a "U" shaped handle 16 mounted to the top surface. Parallel side wall flanges 18 are directed downwardly relative to the top wall and spaced apart a predetermined spacing substantially equal to the predetermined spacing defined between the molding member side walls 11*a*. A top wall opening 19 is formed and provided through the top wall 16. With reference to the FIGS. 4 and 7, it may be noted that the top wall opening 19 receives a liquid compound 20 that is directed for subseguent hardening, wherein such compounds are arranged to include an epoxy resin and hardener that may be provided through the top wall opening 19 between the support side wall flanges 18. A cavity interface 21 is filled with the liquid compound 20 as a bottom surface of the top wall 16 is spaced from the molding member top surface 12. In this manner, a mirror image mold configuration 23 is formed within the support 15 between the side walls 18 and the bottom surface of the top wall 17. An adhesive, such as a liquid adhesive, 24 is directed onto the exposed mold configuration 23, wherein subsequently abrasive particles 25 are dispersed about and onto the adhesive. The adhesive is then allowed to dry, wherein the support side wall flanges 18 maintain a projection beyond the mold configuration 23 and thereby permit receiving of the molding member 11 between the flanges 18 in confronting relationship with the mold configuration and the abrasive particles to provide for a sanding tool to finish a unique molding member 11, such as illustrated in FIG. 1 for example.

Figure 3:
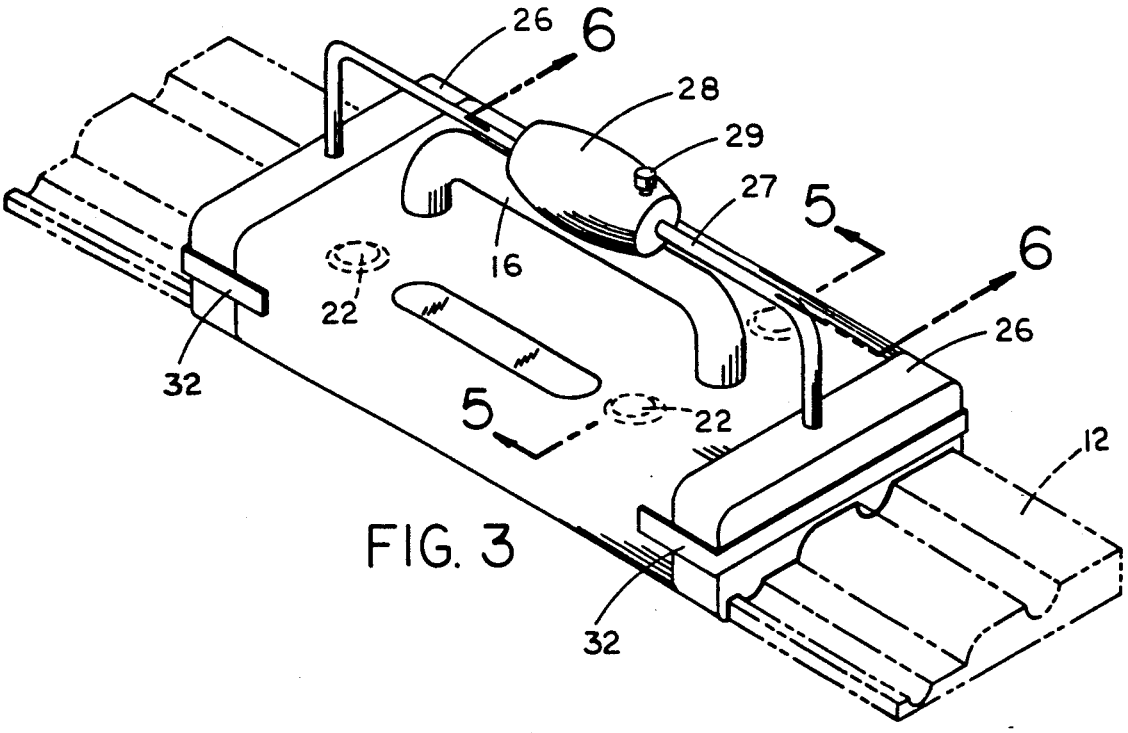
FIG. 3 is an isometric illustration of a modified tool structure contemplated by the invention.
Figure 4:
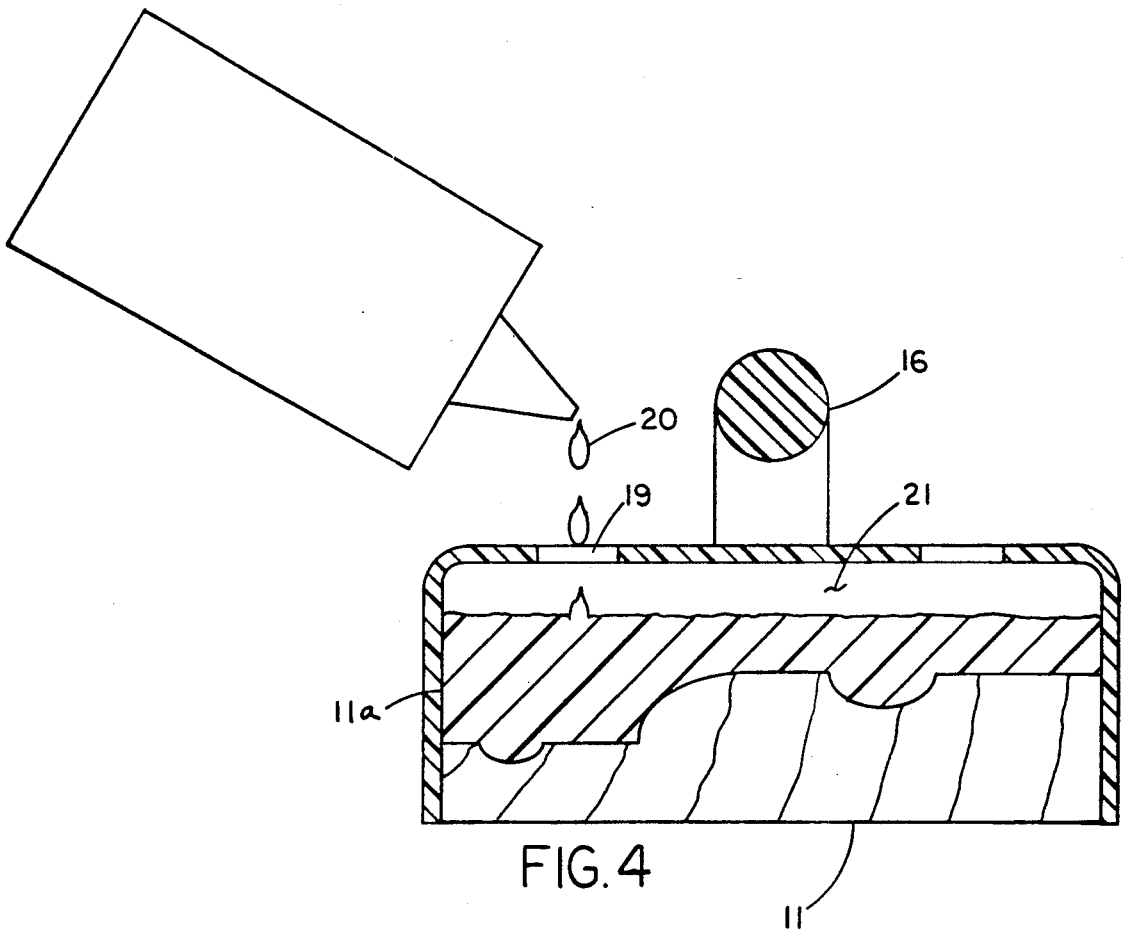
FIG. 4 is an orthographic view, taken along the lines 4—4 of FIG. 1 in the direction indicated by the arrows.
Figure 5:
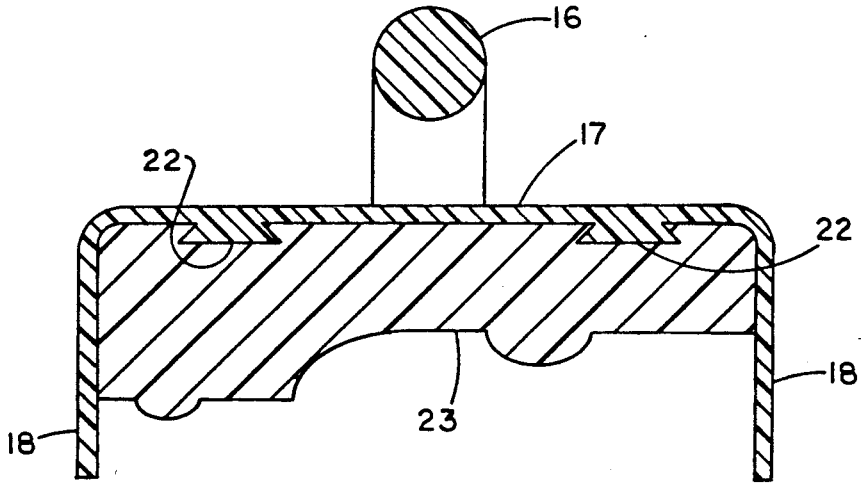
FIG. 5 is an orthographic view, taken along the lines 5—5 of FIG. 3 in the direction indicated by the arrows.
Figure 6:
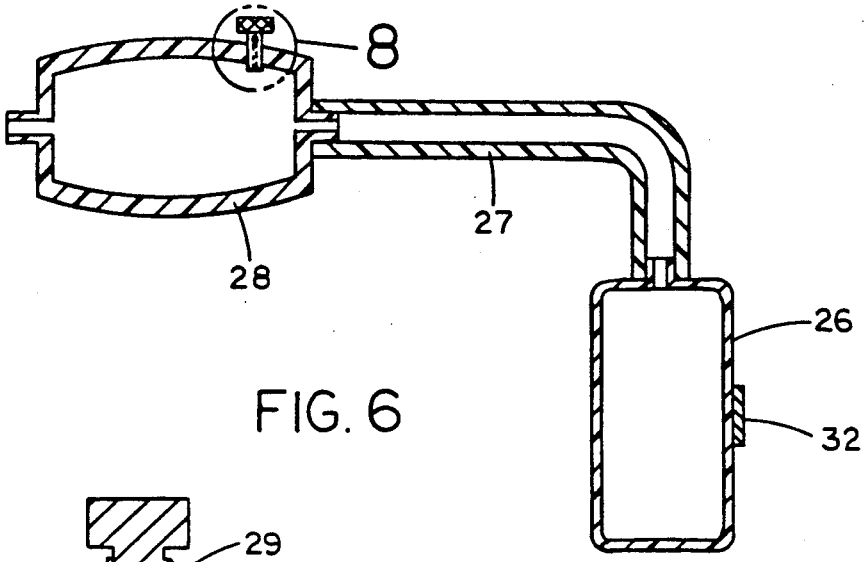
FIG. 6 is an orthographic view, taken along the lines 6—6 of FIG. 3 in the direction indicated by the arrows.
Figure 8:
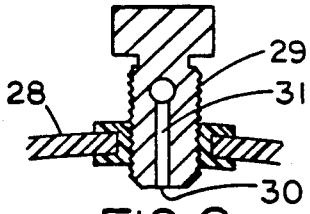
FIG. 8 is an orthographic cross-sectional illustration of the check valve as set forth in section 8 of FIG. 6.
Figure 7:
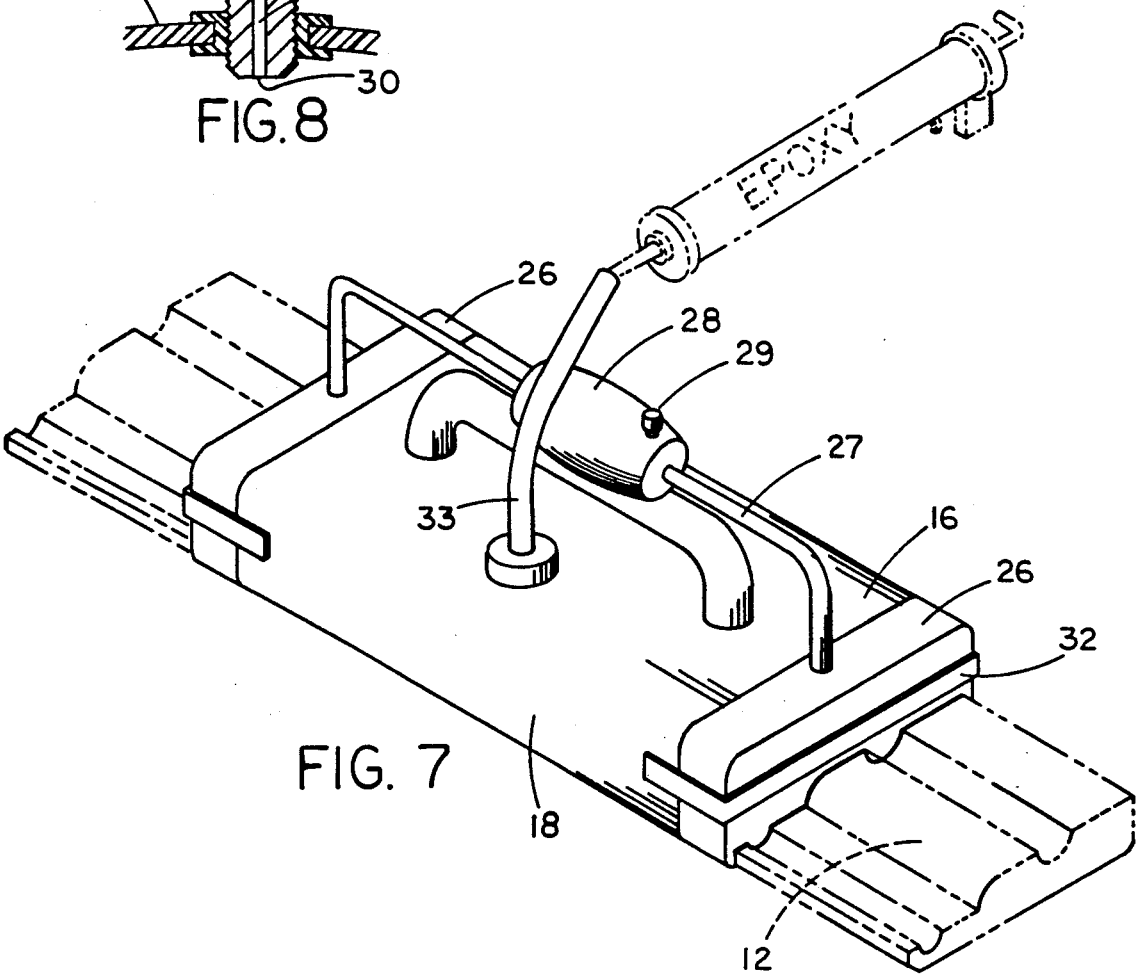
FIG. 7 is an isometric illustration of the modified molding tool structure of the invention.

A modification of the tool and its construction is illustrated in the FIG. 3, to include pneumatic chambers 26 mounted to each end of the "U" shaped support to be utilized in lieu of taping and damming of the "U" shaped support ends. The pneumatic chambers 26 are in communication with a pneumatic conduit 27, with a pneumatic pump member 28 positioned within the pneumatic conduit 27 for the pressurizing of the pneumatic chambers 26 and their conforming to the top surface 12 of the mold member. The use of a pump member 28 to include a check valve 29 (see FIG. 8) that is formed with a flap member 30 at a lower distal end of a check valve conduit 31 is arranged to effect closure of the conduit 31 upon pressurizing of the pump member 28.

The pneumatic chambers 26 each include a pneumatic chamber strap 32 extending about the pneumatic chamber for securement of the pneumatic chamber to the flanges 18 in use. Further, the FIG. 7 further illustrates the availability of an epoxy directing conduit 33 in communication with the top wall opening 19 positioned below the conduit 33 to effect ease of filling of the cavity interface 21.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A method of making a finishing tool to include an abrasive surface complementary to a molding member top surface, wherein the molding member includes spaced side walls spaced apart a predetermined spacing, wherein the method of forming the tool comprises, providing a "U" shaped support, including a support top wall with a handle mounted to the top wall, parallel side wall flanges, and the top wall including a top wall opening, and positioning the "U" shaped support over the molding member, directing a hardening compound through the top wall opening, and thereby creating a mirror image mold configuration of the molding member between the top wall, the side wall flanges, and the molding member top surface wherein "U" shaped support and the mirror image mold configuration are secured together when the hardening compound cures.

2. A method as set forth in claim 1 wherein a ant coating is applied to the molding member top surface prior to positioning the "U" shaped support over the molding member, and wherein the "U" shaped support is formed to include the side wall flanges spaced apart a predetermined spacing equal to a predetermined spacing defined between the molding member side walls.

3. A method as set forth in claim 2 wherein the support top wall includes a top wall bottom surface, wherein the top wall bottom surface is spaced from the molding member top surface to define a cavity interface between the support top wall and the molding member.

4. A method as set forth in claim 3 wherein the "U" shaped support and the hardening compound are removed from the molding member and the hardening compound is coated with an adhesive about an exposed surface of the hardening compound and subsequently, abrasive particles are directed about the adhesive to form an abrasive sanding surface of a mirror image configuration to the molding member top surface.

* * * * *